US005765663A

United States Patent [19]

Jamieson et al.

[11] Patent Number: 5,765,663

[45] Date of Patent: Jun. 16, 1998

[54] METHODS AND APPARATUS FOR PREVENTING UNDUE WEAR OF ELEVATOR ACTUATORS

[75] Inventors: Eric K. Jamieson, Farmington; Daniel S. Williams, Meriden, both of Conn.

[73] Assignee: Otis Elevator Company, Farmington, Conn.

[21] Appl. No.: 743,023

[22] Filed: Nov. 4, 1996

[51] Int. Cl.[6] ..... B66B 1/34; B66B 11/02

[52] U.S. Cl. ..... 187/292; 187/391; 187/409

[58] Field of Search ..... 187/292, 281, 187/394, 391, 393, 409, 410, 278

[56] References Cited

U.S. PATENT DOCUMENTS

| | | | |
|---|---|---|---|
| 3,087,583 | 4/1963 | Bruns | 187/95 |
| 3,099,334 | 7/1963 | Tucker | 187/95 |
| 5,086,882 | 2/1992 | Sugahara et al. | 187/95 |
| 5,117,946 | 6/1992 | Traktovenko et al. | 187/95 |
| 5,294,757 | 3/1994 | Skalski et al. | 187/115 |
| 5,367,132 | 11/1994 | Skalski et al. | 187/393 |
| 5,439,075 | 8/1995 | Skalaski et al. | 187/410 |
| 5,652,414 | 7/1997 | Roberts et al. | 187/292 |

FOREIGN PATENT DOCUMENTS

| | | | |
|---|---|---|---|
| 8133625 | 5/1996 | Japan | B66B 7/02 |

*Primary Examiner*—Robert Nappi

[57] ABSTRACT

Methods and apparatus are provided which can reduce life cycle costs associated with wear on active horizontal suspension actuators for elevators and also reduce cost of such actuators. The method includes discriminating lateral movement of elevator due to car loading imbalance from that of movement due to building sway and operating the actuators only in the case of lateral movement due to car loading imbalance. The discriminating may comprise the steps of detecting a car position outside a deadband, and allowing changes in the actuators to counter the forces causing such positional changes only if the car position stays outside the deadband for more than a predetermined time, e.g., more than half the predetermined period of building sway, which is an architectural constant for a particular building.

4 Claims, 3 Drawing Sheets

METHODS AND APPARATUS FOR PREVENTING UNDUE WEAR OF ELEVATOR ACTUATORS

TECHNICAL FIELD

The invention relates to elevators and methods and apparatus for preventing undue wear of elevator actuators used for active horizontal suspensions. More particularly, the invention relates to a method for preventing undue wear of elevator actuators by providing methods and apparatus for discriminating lateral movements of the elevator car due to car loading imbalance from lateral movements of elevator due to building sway caused by outside wind forces.

BACKGROUND OF THE INVENTION

During the vertical operation of an elevator, or even while standing still, there are several causes which force the car to move horizontally in a side-to-side or front-to-back direction. The prior art recognizes that such lateral displacements can be caused by, for example, passenger movement, rail bumps and wind gusts inside of the hoistway. Resultant movements and/or vibrations of the car owing to these problems can cause the car platform to tip or accelerate horizontally, and this type of tip or acceleration can lower the ride quality. Therefore, it is important to reduce lateral movements of the car platform for improving ride quality.

Many prior art patents are known to reduce the lateral movement of the car. U.S. Pat. Nos. 3,087,583 to W. H. Bruns and 3,099,334 to B. W. Tucker, Jr. disclose typical prior art elevator cab assembly guidance systems of the roller cluster type. As disclosed in U.S. Pat. No. 3,099,334, there are adjustable stops provided on the roller pivot arms or bell cranks which limit the extent to which the rollers can pivot away from the guide rail blades so as to prevent the latter from touching the slots in the base plate, and also in the cover plate for the upper roller clusters. These prior art roller guide systems provide an acceptable quality ride so long as th cab is relatively evenly loaded with passengers, i.e., so long as the cumulative weight of the passengers is evenly distributed in the cab.

On the other hand, U.S. Pat. No. 5,117,946 to Traktovenko et al. discloses an elevator cab assembly having a rail guidance system which provides a substantially vibration-free ride despite uneven passenger loading. The rail guide rollers are pivotally mounted on links which are spring-biased toward the guide rail blades. Actuators are connected to the link spring to selectively increase the spring pressure acting on the links when the pivot stops are engaged as a result of uneven passenger loading in the cab. The actuators ensure that the roller links do not ride against the stops, thereby ensuring a continuous spring biased engagement between the guide rollers and the guide rail blades, and a substantially vibration-free ride. This patent is designed to cope with the carframe-tip which is caused by uneven passenger loading.

As these prior art patents teach, it is necessary for the elevator carframe to have a centering control to maintain or improve the ride quality of the elevator. If an imbalance condition exists, the centering control provides additional preloading of the suspension springs using actuators to move the car laterally and re-center the carframe relative to the rails. The centering control bandwidth is very low, and the "centered" condition is only an average condition, based upon position calculations which are conditioned using a low pass filter. At any given instant, however, the car will not be centered relative to the rails due to the vertical travel of the thus stabilized car up or down the hoistway with respect to rails which are not perfectly aligned. These rail-induced conditions of "uncentered car" are relatively high frequency and fall outside of the control bandwidth of the centering control and are, e.g., handled by a relatively low force, electromagnet actuator in a higher frequency control loop.

There are several low frequency carframe displacements which are within the bandwidth of the centering control. In the prior art these have been viewed as primarily due to a single cause, i.e., car float displacements due to passenger load imbalances. However, the prior art of active horizontal suspension has overlooked the important effect of building sway. Building sway amplitudes can be much larger than the typical 6.4 mm car float and of course the car is forced to track the building's lateral motion. Typical building sway frequencies show periods of several seconds. These building sway amplitudes and sway periods (T) vary from building to building and are determined by architects. The sway period is a constant regardless of amplitude. Since building sway forces are low frequency, they act upon the entire car mass. The acceleration on the car, coupled with the mass of the car, creates very large building sway forces on the suspension system of the car. It is not cost effective to design the active horizontal suspension system with the capability of withstanding the building sway forces such that the car remains "centered" with respect to the rails during sway conditions. Therefore it will be difficult for such systems to prevent the car from riding on the stops of the suspension system during such sway conditions.

DISCLOSURE OF INVENTION

The above mentioned active actuators become operative whenever there are low frequency movements of the carframe. This means that the actuators of the above invention become operative during building sway conditions, even while the elevator is standing still. But such attempts are essentially pointless during sway conditions because the suspension system actuators do not have enough force capability to overcome the building sway forces. The actuators used in the centering control are therefore subject to undue wear each time they are activated. Thus, in the application of Active Roller Guide (ARG) elevators, especially high-rise, and high-speed elevators, since they are not effective to counter building sway forces it is cost effective to inhibit further countering operations of actuators when there is a building sway condition.

It is therefore the object of the invention to provide methods and apparatus for discriminating lateral displacements due to building sway from lateral displacements due to car loading imbalance and other low force imbalances, and let the system respond only to them, i.e., by inhibiting operation of the active suspension actuators to counter sway forces during building sway conditions.

This object can be accomplished by providing a method which comprises the steps of discriminating the lateral movement of elevator due to car loading imabalance and similar imbalances from that due to building sway and operating the actuators of the elevator horizontal active suspension to counter such imbalances only in the case of lateral movement due to car loading imbalance and the like.

This invention reduces life cycle costs associated with wear on actuators, particularly on undercar actuators which are more likely to be used in any case. It also reduces cost of such actuators by eliminating the sway force component as a design requirement.

These objects and benefits of the invention will become more readily apparent from the following detailed description of a preferred embodiment thereof when taken in conjunction with the accompanying drawings.

BEST MODE FOR CARRYING OUT THE INVENTION

Figure 1:
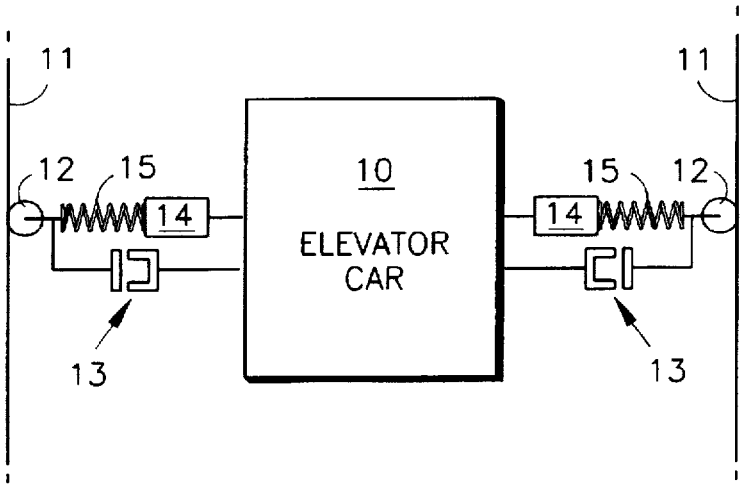
FIG. 1 is a schematic diagram of active roller guides (ARG) with associated carframe in the side to side axis, upon which the sway circumvention technique of the present invention is operative.

FIG. 1 shows a single axis of active roller guide (ARG) control actuators (side to side). Therein, a carframe 10 for an elevator car or cab is supported by rails 11 through rollers 12. Vibration magnets 13 may be used to provide relatively low-force counter-forces to counter high frequency carframe vibrational disturbances resulting chiefly from rail misalignment. Higher-force actuators 14 are used to counter low frequency carframe disturbances due to passenger load imbalances, hoistway wind gusts (from other cars), and the like. Springs 15 may be disposed between the actuators and the rollers or vice versa. It should be realized that these actuators may be disposed, without limitation, between the car or carframe and the hoistway or may be disposed between the carframe and the cab if the cab is suspended within the carframe for imparting forces therebetween in response to a control signal. In one embodiment which is designed to cope with centering the carframe in the case of uneven passenger loading, a ball screw actuator is used, such a disclosed in the above-mentioned Traktovenko et al case, which can be extended or retracted to vary the force exerted on the roller 12, by a coil spring. A link includes a cup which receives one end of the coil spring. The other end of the spring is engaged by a spring guide which is connected to the end of a telescoping ball screw adjustment device by a bolt so as to connect the adjuster to the link through the spring. Carframe lateral displacement relative to the rails is, as previously disclosed by Skalski et al in U.S. Pat. No. 5,294,757, determined by measuring the magnetic flux and current in each vibration magnet, and then calculating the actual gaps.

Figure 2:
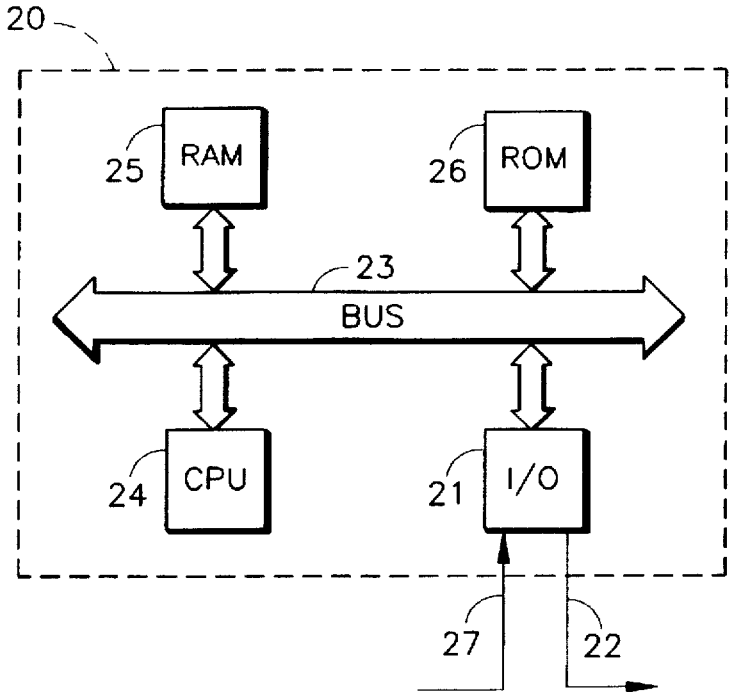
FIG. 2 PRIOR ART
FIG. 2 is an illustration of a signal processor which may be used as the means shown in FIG. 5 for discriminating signals and selectively operating actuators.

Referring now to FIG. 2, a means for discriminating signals and selectively operating actuators is illustrated in a digital signal processor embodiment which may comprise an Input/Output (I/O) device 21 which may include an Analog-to-Digital (A/D) converter (not shown) responsive to one or more analog signals on a line(s) 27 provided by sensor(s), which may be one or more position sensors, or any sensed parameter indicative of the effect(s) of the disturbance(s). The I/O device 21 may further comprise a Digital-to-Analog (D/A) converter (not shown) for providing force command signal on lines 22 to an actuator to counteract the sensed disturbance. Also within the controller 20 of FIG. 2 is a control, data and address bus 23 interconnecting a Central Processing Unit (CPU) 24, a Random Access Memory (RAM) 25 and a Read Only Memory (ROM) 26. The CPU executes a step-by-step program resident in the ROM, stores input signals having magnitudes indicative of the value of the sensed parameters as manifested on the line 27, signals having magnitudes representing the results of intermediate calculations and output signals having magnitudes indicative of the value of the parameter to be controlled as manifested in the output signals on lines 22.

Figure 3:
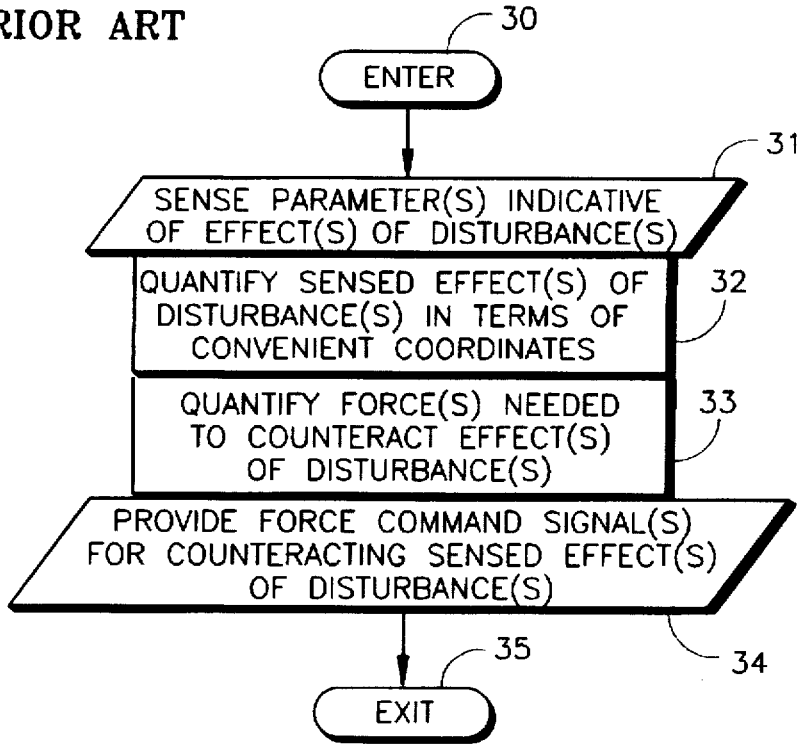
FIG.3 PRIOR ART
FIG. 3 is a prior art illustration of a series of steps which may also be carried out by the processor of FIG. 2 or its equivalent in determining the magnitude of the response required to counteract disturbances.

In conjunction with the arrangement of the cab and/or car platforms, and at the same time referring to FIG. 3, a simplified step-by-step program will be explained for execution by the CPU of FIG. 2 in effecting the prior art means for determining magnitude of response required to counteract disturbance(s). This drawing is shown as an illustration. As may be apparent to the skilled persons in the art, this illustration can be combined with FIG. 4 to accomplish the objects of the invention. After entering at a step 30, an input step 31 is executed in which the magnitude(s) of the signal (s) on line 27 is (are) acquired by the I/O unit 21. These can be stored in the RAM 25 of FIG. 2. They can be used in a step 32 to compute or quantify the magnitude of the sensed effect(s) in terms of a convenient scale or set a coordinates.

A step 33 is next executed in which a computation is made of the forces needed to counteract the effect(s) of the disturbance(s) as manifested in one or more sensed parameter(s). These computed values are provided in the form of force command signals on lines 22 as indicated in a step 34.

After making the necessary computations and providing the required counterforce command signals they are provided to the actuators 14 of FIG. 1 or to both types of actuators 13, 14 and the program may then be exited in a step 35.

Figure 4:
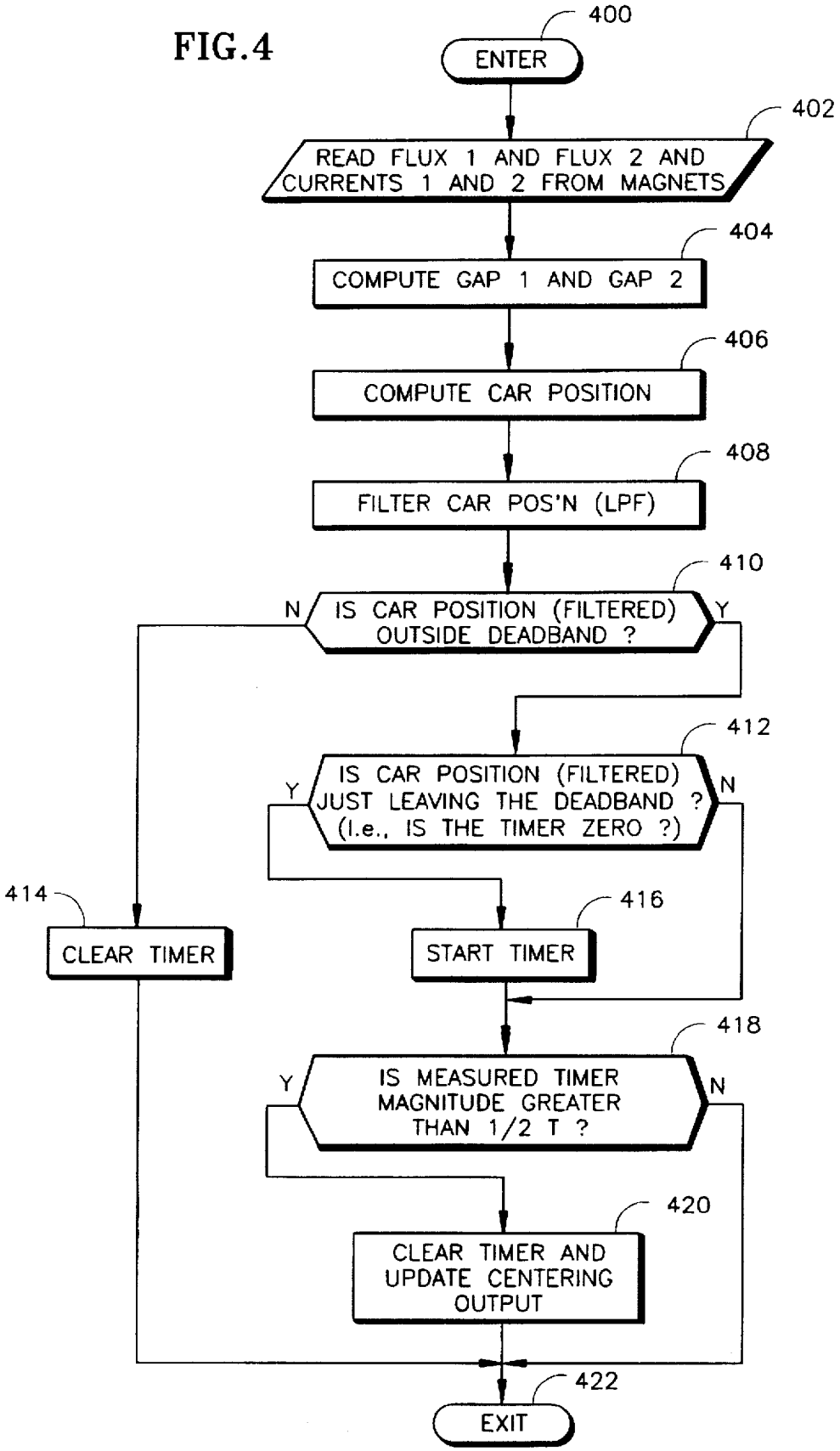
FIG. 4 is a flow diagram according to the present invention which may be carried out in software used in a controller such as that of FIG. 2.

FIG. 4 is a flow diagram of the software logic used in the controller 20 according to the invention. After entering at a step 400, positional data is gathered in a step 402, e.g., by obtaining flux data from flux sensors located in the vibration magnet gaps and vibration magnet current. This data is used to compute magnet gap 1 and magnet gap 2, as shown in a step 404 using the signal processor 20 implementing program steps stored in ROM 26 in FIG. 2. Other means may be used as well. The difference between the gaps may be compared with the average of the two gaps to determine the extent to which the car is not centered laterally as indicated in a step 406. This position information is stored in RAM 25 and lowpass filtered as shown in a step 408 according to program steps stored in ROM 26. The lowpass filtered position information is compared as indicated in a step 410 with position error threshold parameters stored in ROM 26 in FIG. 2. If it is determined in the step, 410 that the filtered position signal is less than a limit, i.e., it is inside a deadband, a software timer is cleared in a step 414 and a return is made in a step 422. In that case, a reentry in the step 400 and reexecution of the steps 402–410 will shortly thereafter reoccur. A long as it is determined, in this repeated fashion, that the elevator car remains within the deadband, the software timer is repeatedly cleared in the step 414 and no changes are permitted in the force output of the actuators. In other words, as long as the car is within the deadband, the status quo of the actuators is maintained. If, on the other hand, the car lateral position is outside the preset "deadband" threshold position stored in ROM 26, then the timer continues to be updated in RAM 25. In the case where the filtered position signal has just left the deadband, the timer is found to be equal to zero, as determined in a step 412 and the timer is started in a step 416. If the timer is non-zero, meaning that the filtered position has already left the deadband for a period of time, then the timer is already started and the step 412 transitions immediately to execute step 418 in which a determination is made as to the magnitude of the timer. If the timer magnitude is greater than one-half of the period of the building sway, meaning that the filtered position signal has been outside the deadband for more than that half period, the it can be safely assumed that the cause of the imbalance is not building sway and therefore a step 420 is executed to clear the timer and update the centering output to the actuators so that they are permitted to correct the imbalance and a return is made in the step 422. If, on the other hand, it is determined that the timer magnitude is less than half of the building sway, then the timer is not cleared and the force outputs of the actuators continue to be inhibited for so long as the filtered position signal remains inside the deadband.

The method of FIG. 4 is enabled by the filtering step 408 to disregard the carframe lateral displacement signal if the lateral displacements of carframe are high-frequency, e.g., caused by high frequency movements due to, for example, rail misalignment within the hoistway, etc. Therefore, it can be seen that in the region outside of the deadband, there are only lateral displacements of the car caused by low frequency movements due to, for example, those caused by building sway or those caused by car loading imbalance. So, if the filtered car position signal remains outside of the deadband for more than one half of the building sway period, which is fixed, then the car displacement can be concluded to be due to load imbalance. In this case the centering force outputs are recomputed based upon the suspension spring constants, and the active suspension system is allowed to restore the car to a centered condition. For example, see U.S. Pat. No. 5,117,946 to Traktovenko et al.

In the case where the car displacement is due to building sway, the car position will re-enter the deadband before the software timer expires. In this case the timer is cleared, but no update in centering force is allowed to be made. This avoids actuating the actuators repeatedly during conditions where the building sway amplitudes cause the car position to cyclically exit and recenter the deadband. As will be understood, the flow chart of FIG. 4 will be operated repetitively, for example, ten times per second.

Figure 5:
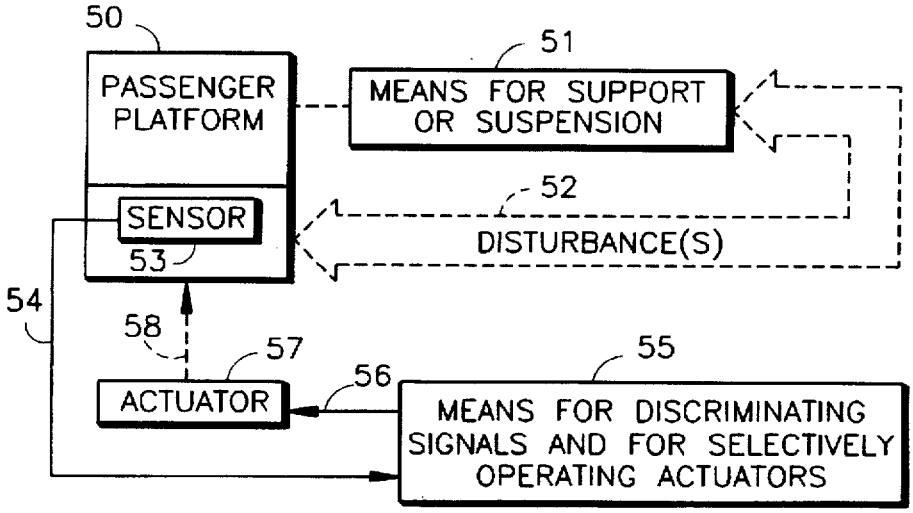
FIG. 5 is a block diagram of a control system for a elevator car or cab, according to the present invention.

In FIG. 5, a passenger platform 50 for an elevator car or cab is suspended or supported by means 51. According to the present invention, one or more displacements (such as a passenger movement during car operation or building sway by outside wind gust, etc.) may be sensed by a sensor 53 disposed in or on the car or cab platform 50, e.g., in close association with the actuators for the active horizontal suspension. The sensor 53 typically senses an effect of the disturbances 52 for providing a signal having a magnitude indicative of the magnitude of the effect on a line 54. Means 55 is responsive to the signal provided on line 54 for discriminating the lateral movement of elevator due to car loading imbalance from the lateral movement of elevator due to building sway for providing a signal on line 56 for commanding selectively, that is only in the case of loading imbalance, an actuator 57 to actuate the platform 50 as indicated by an actuation signal on a line 58 with the forces required to counteract the sensed effect. The actuator 57 may be disposed, without limitation, between the car or carframe and the hoistway or may be disposed between the carframe and the cab for imparting forces therebetween in response to the control signal on line 56.

A plurality of sensors similar to sensor 53 may be disposed to be responsive to one or more selected parameters indicative of translational and rotational movements of the car or cab which cause it to deviate from staying perfectly centered on an imaginary vertical line through the center of the hoistway. Such sensors may be responsive to any one or any number of selected parameters such as the position of the car or cab with respect to the hoistway, the translational accelerations experienced by the car or cab, etc. Such sensors may provide one or more sensed signals to the means 55 or another similar means in order to complete a closed loop for purposes of automatic feedback control.

As suggested above, methods and apparatus which car reduce life cycle costs associated with wear on such actuators and also reduce cost of such actuators are provided by using a specific building sway period and a signal processor which can discriminate the lateral movement of the elevator due to car loading imbalance from that due to building sway and operate the actuators of the elevator active horizontal suspension selectively in the case of lateral movement of the elevator due to car loading imbalance.

Although the invention has been shown and described with respect to an exemplary embodiment thereof, this should be understood that the foregoing and other changes, omissions and additions may be made therein, and thereto, without departing from the spirit and scope of the invention.

What is claimed is:

1. A method for preventing undue wear of actuators for controlling lateral movement of an elevator car, comprising the steps of:

discriminating lateral movement of the elevator car due to car loading imbalance from lateral movement of the elevator car due to building sway; and operating the actuators to counter said lateral movement only in the case of lateral movement of the elevator car due to car loading imbalance.

2. A method as claimed in claim 1, wherein the discriminating step comprises the steps of:

detecting a car position signal transition from less than to greater than a limit of a deadband thereby indicating a car position transition from inside to outside the deadband and starting a timer; and detecting a timer magnitude greater than half a predetermined building sway period for permitting said operating the actuators.

3. An apparatus for preventing undue wear of actuators for controlling lateral movement of an elevator car in a building comprising means for horizontally supporting or suspending the elevator car and means for sensing displacements of the elevator car wherein said apparatus further comprises means for discriminating lateral movement of the elevator car due to car loading imbalance from lateral movement of the elevator car due to sway of the building for operating the actuators to counter said lateral movement only in the case of lateral movement of the elevator car due to forces other than sway of the building.

4. An apparatus as claimed in claim 3, wherein the means for discriminating comprises:

means for detecting a car position signal transition from less than to greater than a limit of a deadband thereby indicating a car position transition from inside to outside the deadband and starting a timer; and means for detecting a timer magnitude greater than half a predetermined building sway period for zeroing the timer and permitting said operating of the actuators to counter said lateral movement.

* * * * *